US005968624A

United States Patent [19]

Liebe, Jr.

[11] Patent Number: 5,968,624

[45] Date of Patent: Oct. 19, 1999

[54] MULTI-LAYERED PLASTIC LETTERING WEB AND METHOD OF PRODUCING

[76] Inventor: Robert James Liebe, Jr., 1577 Kehrs Mill Rd., Chesterfield, Mo. 63005

[21] Appl. No.: 08/994,886

[22] Filed: Dec. 19, 1997

Related U.S. Application Data

[63] Continuation-in-part of application No. 08/513,388, Aug. 10, 1995, Pat. No. 5,702,790, which is a continuation-in-part of application No. 08/134,184, Oct. 8, 1993, Pat. No. 5,441,785, which is a continuation-in-part of application No. 07/856,128, Mar. 23, 1992, abandoned, which is a continuation-in-part of application No. 07/636,877, Jan. 2, 1991, Pat. No. 5,112,423.

[51] Int. Cl.[6] ..... A61F 13/02

[52] U.S. Cl. ..... 428/40.1; 428/40.2; 428/41.2; 428/41.5; 428/46; 428/195; 428/207; 428/343; 428/346; 428/347; 428/352; 156/230; 156/236; 156/238; 156/239; 156/247

[58] Field of Search ..... 428/40.1, 41.2, 428/195, 200, 212, 207, 216, 343, 346, 347, 352, 46, 40.2, 41.5; 156/230, 257, 236, 238, 239, 247; 524/591, 839

[56] References Cited

U.S. PATENT DOCUMENTS 5,095,069 3/1992 Ambrose et al. ..... 524/591
5,441,785 8/1995 Liebe, Jr. ..... 428/41

*Primary Examiner*—Deborah Jones
*Assistant Examiner*—Abraham Bahta
*Attorney, Agent, or Firm*—Armstrong Teasdale LLP

[57] ABSTRACT

A multi-layered signage-lettering material containing a release or casting sheet layer with a pigmented display layer deposited on one side of the release sheet is described. The pigmented display layer is a coalesced film of at least one water-borne polymer of for example water-borne polyurethanes, water-borne acrylics, and mixtures thereof. Optionally, the coalesced film may be applied in multiple coats. The multi-layered material also includes an adhesive layer covering the surface of the pigmented display layer opposite the release sheet, and optionally, a removable protective layer covering the surface of the adhesive layer opposite the pigmented display layer. A method of fabricating the multi-layered signage-lettering material described above also is described. The method includes first depositing the pigmented display layer on the release or casting sheet. This is accomplished by first dispersing pigment in at least one water-borne polymer for example, water-borne polyurethanes, water-borne acrylics, and mixtures thereof. Additionally, functional additives may be added to improve flow, wetting, and foaming characteristics of the resultant mixture. The mixture is then made machine spreadable by adding water and/or a viscosity modifying agent. The mixture is then machine spread on the release sheet and the water is evaporated allowing for coalescence and film formation. A layer of adhesive is then applied to the surface of the pigmented display layer opposite the release sheet and optionally, on top of the adhesive, opposite the pigmented display layer, a removable protective layer is applied.

19 Claims, 1 Drawing Sheet

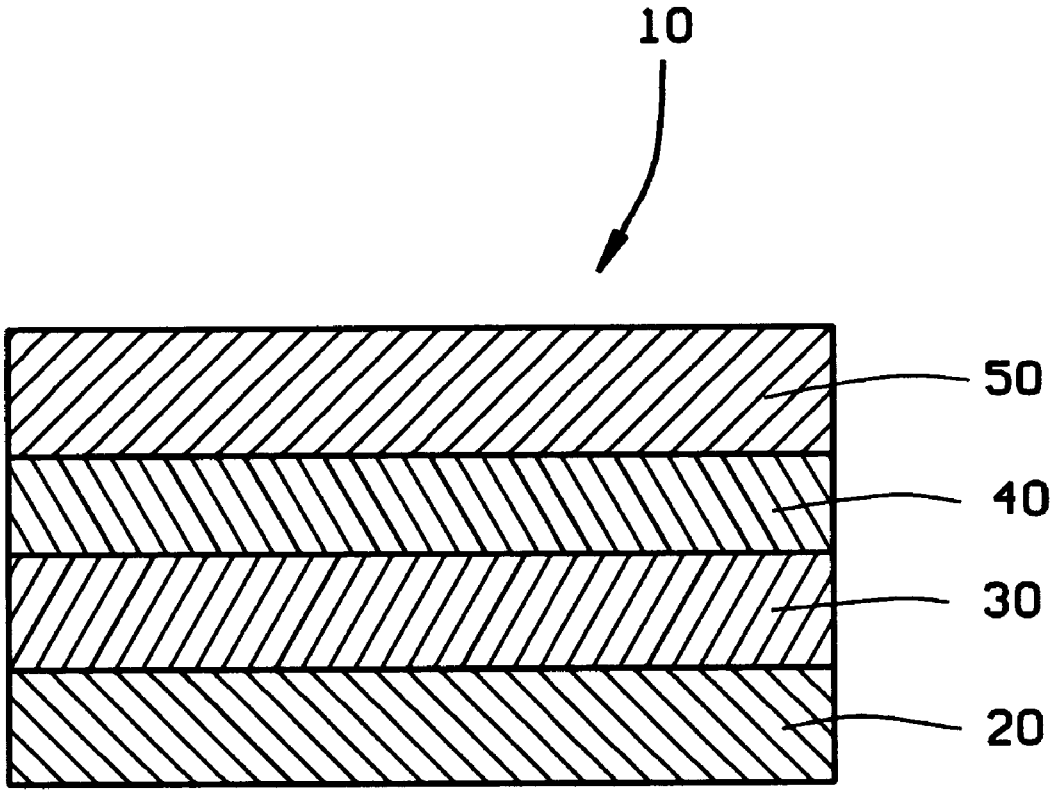
10
50
40
30
20

MULTI-LAYERED PLASTIC LETTERING WEB AND METHOD OF PRODUCING

This application is a continuation-in-part of U.S. patent application Ser. No. 08/513,388, filed Aug. 10, 1995 entitled "Water-Added Evaporation Process For Making Thin Plastic Lettering Webs", to issue Dec. 30, 1997 as U.S. Pat. No. 5,702,790, which is a continuation-in-part of U.S. Pat. No. 5,441,785, which is a continuation-in-part of U.S. patent application Ser. No. 07/856,128, filed Mar. 23, 1992, abandoned, which is a continuation-in-part of U.S. Pat. No. 5,112,423. application Ser. No. 08/513,388 is hereby incorporated herein, in its entirety, by reference.

FIELD OF THE INVENTION

This invention relates generally to a multi-layered plastic lettering web and more particularly, to a multi-layered plastic lettering web having a pigmented water-borne polymer display layer.

BACKGROUND OF THE INVENTION

Lettering sets, including a pigmented plastic display layer backed by an adhesive layer, to be computer cut and retained in position on a transparent stripable release sheet, are familiarly used for applying athletes' names, numbers and team logos to their athletic garments. Three-layer lettering sets, using a pigmented polyvinyl chloride plastic lettering display sheet backed by a sheet of adhesive and having a transparent front release sheet, which aids in positioning on garments or other substrates, are described in U.S. Pat. Nos. 5,112,423 and 5,441,785 to Liebe. Outlines of lettering elements in mirror-image are cut starting through the adhesive sheet and through the lettering sheet, to and sometimes into but not through, the release sheet.

In another form, lettering sets are made with a pigmented polyvinyl chloride (PVC) display layer with an adhesive backing sheet but without the paper forward sheet on which the PVC was originally cast. The cutting proceeds in direct, not mirror-image, order, first through the pigmented layer and then through the adhesive layer. After the portion between the lettering outlines have been removed, a handling sheet, usually a transparent sheet whose surface is somewhat adherent, is pressed against the forward side of the lettering elements to lift them and position them in place on a garment or other substrate.

Polyvinyl chloride materials are inexpensive but require temperatures of about 320° .F to form a film. PVC materials may contain solvents to aid in spreading and casting the display layer film. U.S. Pat. No. 5,312,645 suggests that a solvent-based polyurethane may be substituted for PVC to gain improved tensile strength, abrasion resistance and capacity for elongation. A film of a solvent-based polyurethane may be formed at a temperature necessary for solvent evaporation, which may be as low as ambient temperature.

A problem associated with solvent-based materials being used as pigmented display layers is that the choice of the material of the release or casting sheet is limited to materials that are resistant to the solvents used in the pigmented display layer and resistant to the temperature of the solvent evaporation process. Typically, paper and polyester release or casting sheets are used in the manufacture of lettering sets because of their resistance to solvent and heat distortion.

It would desirable to be able to use a release sheet that is more flexible than the typical paper or polyester release sheets. It also would be desirable to be provide a release sheet that is thin to achieve greater flexibility.

SUMMARY OF THE INVENTION

These and other objects may be attained by a multi-layered signage-lettering material containing a release or casting sheet layer with a pigmented display layer deposited on one side of the release sheet. The pigmented display layer includes a coalesced film of at least one water-borne polymer of, for example, water-borne polyurethanes, water-borne acrylics, and mixtures thereof. Optionally, the coalesced film may be applied in more than one coat. The multi-layered material also including an adhesive layer covering the surface of the pigmented display layer opposite the release sheet, and optionally, a removable protective layer covering the surface of the adhesive layer opposite the pigmented display layer.

In another aspect, the present invention is a method of fabricating the multi-layered signage-lettering material described above. The method includes first depositing the pigmented display layer on the release or casting sheet. This is accomplished by first dispersing pigment in at least one water-borne polymer, for example, water-borne polyurethanes, water-borne acrylics, and mixtures thereof. Additionally, functional additives may be added to improve flow, wetting, and foaming characteristics of the resultant mixture. The mixture is then made machine spreadable by adding water and/or a viscosity modifying agent. The mixture is then machine spread on the release sheet and the water is evaporated allowing for coalescence and film formation. A layer of adhesive is then applied to the surface of the pigmented display layer opposite the release sheet and then optionally, on top of the adhesive, opposite the pigmented display layer, a removable protective layer is applied.

Because the method and signage-lettering material of the present invention include the use of water-borne polymers, instead of solvent-borne polymers, several advantages are realized. One advantage is that the process is more environmentally friendly because of lower solvent emissions. Another advantage is the ability to use a material for the casting or release sheet that is thin and more flexible. The increased flexibility of the material permits the new use of the signage-lettering material on corrugated and sharply angled substrates.

BRIEF DESCRIPTION OF THE DRAWING

The drawing is a schematic cross section view of a multi-layered signage-lettering material.

DETAILED DESCRIPTION

The drawing is a schematic cross section view of a multi-layered signage-lettering material 10. Signage-lettering material 10 may include four layers. Specifically, material 10 includes a release or casting layer 20, a pigmented display layer 30, an adhesive layer 40, and optionally, a removable protective layer 50.

Release layer 20 may be a release sheet sometimes referred to as a casting sheet and may be comprised of any material that will retain its shape and integrity after the application of pigmented display layer 30 on to one surface of release layer 20. Suitable materials for use as release layer 20 include, but are not limited to, PVC, flexible PVC, polyesters, heat stabilized polyesters, polyolefins, and the like. Release layer 20 may be transparent, translucent, or opaque, but preferably release layer is transparent or translucent. The thickness and flexibility of release layer 20 may be chosen to be compatible with and conform to the substrate that the lettering material is to be applied to.

Pigmented display layer 30 is formed on one surface of casting layer 20. Display layer 30 is a dried film formed by the coalescence of a water-borne polymer composition comprised of pigment dispersed into at least one water-borne polymer. The terms water-borne polymer and water-based polymer as used herein are synonymous and include water soluble polymers and water dispersible polymers including latex emulsions. Suitable water-borne polymers include water-borne polyurethanes, water-borne acrylics, mixture thereof, and he like. Generally, the amount of water-borne polymer in the polymer composition ranges from about 50 to about 65 percent by weight. The pigment s dispersed into the water-borne polymer at an appropriate pigment loading to achieve opacity at the desired film thickness. Typically, the amount of pigment in the polymer composition ranges from about 20 to about 40 percent by weight.

The polymer composition may also contain various additives to adjust the polymer composition properties. For example, dispersents, wetting agents, flow control additives, anti-foam additives, and the like may be used. Typically, when an additive is present in the polymer composition, it is present in a range of about 0.01 to about 5 percent by weight.

Water and/or viscosity modifiers may be used to adjust the flow characteristics of the polymer composition so as to permit the polymer composition to be applied to casting layer 20. Typically the polymer composition is applied by spreading with reverse roll-coaters, rotating screens, and knife or spreading blades, but other methods such as spraying, flowing or flooding may be used. The application may be manual as by hand or by an automatic machine.

In one embodiment, the coalesced film of display layer 30 may be comprised of multiple coats of the polymer composition. Optionally, each subsequent coat may be comprised of a polymer composition containing different pigments and/or pigment concentrations.

In one embodiment, the polymer composition has the following composition (percentages are by weight, and % solids are by weight):

| | |
|---|---|
| Aliphatic polyurethane in water (34% solids) | 53% |
| Acrylic emulsion in water (40% solids) | 7% |
| Water-dispersed pigment (20–70% solids, depending on color) | 33% |
| Polyacrylate viscosity modifier | 4% |
| Anti-foam additive | 1% |
| Flow and leveling additive | 1% |
| Anti-mar and release agent | 1% |

After application of the polymer composition to casting layer 20, water is evaporated from the polymer composition, typically, by heated air of about 200° F. to about 240° F., to form a dry coalesced film or display layer on the surface of casting sheet 20.

Adhesive layer 40 is then applied to the surface of pigmented display layer 30 opposite casting layer 20. Adhesive layer 40 may be a thermoplastic adhesive such as a thermoplastic polyester adhesive, or adhesive layer may be a pressure sensitive adhesive. Adhesive layer 40 may be applied by any method known in the art, including lamination, reverse roll coat, knife, gravure, spray and screen printing methods.

Optionally, removable protective layer 50 is then applied on to the exposed surface of adhesive layer 40. A standard protective sheet or paper such as a silicon-coated protective sheet capable of peeling cleanly form adhesive layer 40 may be used. Alternatively, a layer of a water soluble polymer forming a water soluble film on the surface of adhesive layer 40 may be used. When multi-layered lettering material 10 is to be affixed to a substrate, the water soluble film is washed off with water. The addition of a colorant to the water soluble polymer film is helpful to insure that removable protective layer 50 is completely removed. Typically, removable protective sheet 50 is used if a pressure sensitive adhesive is used.

In addition to the advantage of using lower temperatures to evaporate water, the use of water-born urethanes and acrylics have other significant advantages. Because there is neither a high fusion temperature nor any use of solvents, a greater choice of casting or release sheets is afforded. For example, casting sheets such as flexible PVC may be used even though flexible PVC is not resistant to high temperatures or solvents. Additionally, the low temperatures employed in the process permits the use of very thin flexible release sheets which could not normally withstand substantially higher temperatures. Using such delicate release sheets makes possible the new use of lettering sets on corrugated or even sharply angled substrates, such as metal truck bodies which have angled portions. For these uses, release sheets selected should be thin and as flexible as possible.

If webs on hand have release sheets that are too firm or too flexible for an intended use, such release sheets may be stripped off. Then, release sheets of desired flexibility of firmness may be pressed in place on the surface of the pigmented layer.

Another advantage is that because no migratory plasticizer is used in the process, the potential degradation of the pigmented display layer, adhesive layer and some types of casting or release sheets through plasticizer migration is eliminated.

From the preceding description of various embodiments of the present invention, it is evident that the objects of the invention are attained. Although the invention has been described and illustrated in detail, it is to be clearly understood that the same is intended by way of illustration and example only and is not to be taken by way of limitation. Accordingly, the spirit and scope of the invention are to be limited only by the terms of the appended claims.

We claim:

1. A multi-layered signage-lettering material comprising:

a release or casting sheet layer;

a pigmented display layer deposited on one side of said release sheet, said pigmented display layer comprised of a coalesced film of at least one water-borne polymer chosen from a group comprising water-borne polyurethanes, water-borne acrylics, and mixtures thereof; and an adhesive layer covering a surface of said pigmented display layer opposite said release sheet.

2. A multi-layered signage-lettering material in accordance with claim 1 wherein said adhesive layer comprises a pressure sensitive adhesive.

3. A multi-layered signage-lettering material in accordance with claim 2 additionally comprising a removable protective layer covering a surface of said adhesive layer opposite said pigmented display layer.

4. A multi-layered signage-lettering material in accordance with claim 1 wherein said adhesive layer comprises a thermoplastic adhesive.

5. A multi-layered signage-lettering material in accordance with claim 3 wherein said removable protective layer comprises a release paper.

6. A multi-layered signage-lettering material in accordance with claim 3 wherein said removable protective layer comprises a water soluble film.

7. A process of fabricating signage-lettering material, said method comprising the steps of:

(a) fabricating a pigmented display layer on a release or casting sheet, said fabricating the pigmented display layer on the release sheet comprising the steps of:

(i) dispersing pigment in at least one water-borne polymer chosen from a group comprising water-borne polyurethanes, water-borne acrylics, or mixtures thereof, along with a predetermined amount of functional additives, chosen from the group comprising wetting agents, flow control additives, anti-foam additives, and mixtures thereof, to form a pigmented water-borne polymer composition;

(ii) mixing the pigmented water-borne polymer composition with such amount of water and such amount of viscosity modifying agent as to make the resultant mixture machine-spreadable;

(iii) machine-spreading the resultant polymer mixture on one surface of a release sheet at such spread thickness as will, on subsequent drying, shrink, coalesce and harden to a chosen film thickness; and (iv) evaporating all water therefrom to shrink and coalesce the spread polymer mixture into a thin, pigmented display layer adhered on one surface of the release sheet; and (b) applying to the surface of the pigmented display layer, opposite the release sheet, a layer of adhesive.

8. A process in accordance with claim 7 wherein the layer of adhesive comprises a pressure sensitive adhesive.

9. A process in accordance with claim 8 additionally comprising the step of applying to the surface of the adhesive, opposite the pigmented display layer, a removable protective layer.

10. A process in accordance with claim 7 wherein the layer of adhesive comprises a thermoplastic adhesive.

11. A process in accordance with claim 9 wherein the removable protective layer comprises a release paper.

12. A process in accordance with claim 9 wherein the removable protective layer comprises a water soluble film.

13. A process in accordance with claim 7 wherein the functional additives are dispersents.

14. A process in accordance with claim 7 wherein the functional additives are wetting agents.

15. A process in accordance with claim 7 wherein the functional additives are flow control additives.

16. A process in accordance with claim 7 wherein the functional additives are anti-foam additives.

17. A process in accordance with claim 7 additionally comprising the step of revising the signage-lettering material for a particular use, said revising the material step comprising the steps of:

stripping off the release sheet from the pigmented display layer; and pressing in its place onto the pigmented display layer, a release sheet of flexibility chosen for such particular intended use.

18. A multi-layered signage-lettering material in accordance with claim 1 wherein said release sheet comprises a transparent release sheet.

19. A process in accordance with claim 7 wherein the release sheet comprises a transparent release sheet.

* * * * *